US005757142A

United States Patent [19]

Kong

[11] Patent Number: 5,757,142

[45] Date of Patent: May 26, 1998

[54] FLUORESCENT LIGHT DIMMER

[76] Inventor: Qin Kong, 13928 Mustang Hill La., Gaithersburg, Md. 20878

[21] Appl. No.: 698,718

[22] Filed: Aug. 16, 1996

Related U.S. Application Data

[60] Provisional application No. 60/002,454 Aug. 16, 1995.

[51] Int. Cl.[6] ..... H05B 37/02

[52] U.S. Cl. ..... 315/224; 315/307; 315/291; 315/DIG. 4; 315/DIG. 7

[58] Field of Search ..... 315/307, 200 R, 315/209 R, 219, 224, 282, 255, 244, 247, 291, 294, 324, DIG. 4, DIG. 7

[56] References Cited

U.S. PATENT DOCUMENTS

| | | | |
|---|---|---|---|
| 4,651,060 | 3/1987 | Clark | 315/199 |
| 4,734,650 | 3/1988 | Alley et al. | 315/DIG. 4 X |
| 4,766,353 | 8/1988 | Burgess | 315/324 |
| 4,855,646 | 8/1989 | Peckitt et al. | 315/175 |
| 5,345,150 | 9/1994 | Biegel | 315/280 |

OTHER PUBLICATIONS

Article entitled: ML4831EVAL User's Guide, by George A. Hall, printed on Jul. 7, 1994, ten pages.

*Primary Examiner*—Robert Pascal
*Assistant Examiner*—Haissa Philogene
*Attorney, Agent, or Firm*—Edwin H. Paul; Perkins, Smith & Cohen, LLP

[57] ABSTRACT

An electronic drive for fluorescent lamps that includes a feedback loop arrangement where a lumen or intensity setting is compared to the lamp current and the frequency of an inverter is changed to bring the lumen output of the lamp to a level that matches the setting. The bandwidth of the feedback loop is great enough such that the time delay around the feedback loop is faster than prior art designs, and is preferably about 50 microseconds. This fast feedback loop provides the advantage that fluorescent lamps, and especially the more non-linear fluorescent lamps, can to be dimmed down to 10–30% of normal full scale lumen output without extinguishing. The faster feedback loop also prevents flicker when as the lamp is dimmed.

7 Claims, 4 Drawing Sheets

FLUORESCENT LIGHT DIMMER

RELATED APPLICATION

Priority is claimed under 35 U.S.C. 119(e) from the Provisional Application, Serial No. 60/002454, filed on Aug. 16, 1995, and of same title and inventors Qin Kong, the present inventor and Mr. Richard May. Mr. May is not an inventor of any of the claims of this application.

FIELD OF THE INVENTION

The present invention relates generally to devices for controlling the light intensity output of a fluorescent light. In particular the present invention relates to systems where the light intensity is dimmed or reduced from full output to accommodate the user's specific tolerances such that viewing of items entails less glare and fewer shadowed or dark areas within the viewers sight.

BACKGROUND OF THE INVENTION

Fluorescent lights are by their nature non-linear. That is, a reduction in electrical energy to a fluorescent lamp does not cause a corresponding reduction in light intensity out from the lamp. Indeed there will be a point where the lamp extinguishes even though there is electrical energy being supplied to the lamp. Herein lamp is defined as the fluorescent tube or bulb.

There have been prior attempts to control the lumen or light intensity output from a fluorescent lamp. One such attempt is found in U.S. Pat. No. 5,345,150, entitled REGULATING LIGHT INTENSITY BY MEANS OF MAGNETIC CORE MULTIPLE WINDINGS, which issued Sep. 6, 1994 to Biegel and is assigned to Stocker & Yale, Inc. This invention discloses a variable inductor formed by two windings on a common core. The current through one winding (the control winding) affects the degree of saturation of the core. The inductance of the second winding is directly affected by the degree of saturation and so the second winding inductance. The second winding inductance directly influences the current and so the lumen output of the lamp connected to the second winding.

Another device for controlling the lumen output of a fluorescent lamp is found in U.S. Pat. No. 4,855,646, entitled FLUORESCENT ILLUMINATOR WITH INVERTER POWER SUPPLY, which issued on Aug. 8, 1989 to Peckitt et al. and assigned to Techni-Quip Corp. This invention discloses apparatus to vary the lumen output between two or more lumen levels. Apparatus is disclosed with a relatively fixed AC voltage amplitude and frequency. Control is exercised by adjusting the lamp current by changing the impedance of the circuitry (and so the current) connecting the power source to the lamp.

Another fluorescent dimmer is described in a user's guide, ML 4831, from Micro Linear published on Jul. 7, 1994. This guide is incorporated by reference herein as though laid out in full. The Guide describes a theory of operation and circuitry for a Dimmable Electronic Ballast that is particularly suitable for driving T8 and T12—types of fluorescent lamps. Other fluorescent lamps may also be driven from the described circuitry. This circuit uses a feedback loop where the frequency of the lamp current is changed in accordance to the amount of dimming selected. When the frequency is increased the load impedance presented by the lamp and associated circuitry increases (an inductive dominated load for these frequencies) resulting in lower lamp current and less output light. The operation is to sample the lamp current, convert the sampled current into a voltage and use the voltage to drive inverter stages at different frequencies. The operation is from about 30K Hz to 50K Hz. The inverter output is converted into the lamp current by the driving transformer and other associated circuitry. However, as the light output is diminished there will be a threshold where the lamp will be extinguished and will not restart. The Micro Linear circuitry is optimized for T8 and T12 types of fluorescent lamps and the performance of this circuitry will usually be unsatisfactory for other types of lamps. On page four of the User's Guide operation with other types of fluorescent lamps is discussed. Changing turns ratios on transformers and changing circuit values are suggested. But, these suggestions are aimed at increasing voltages or matching impedances or to affect pre-heat of the lamps. A limitation of the Microlinear circuitry when dimming is that the feedback loop used to control the fluorescent lamp is slow. The loop bandwidth is about 160 Hz. FIG. 1 shows the lamp current for the Micro Linear circuitry under dimming conditions where the lamp current occurs as peaks separated by about 5 milliseconds. The light output under such driving conditions has a noticeable flicker, and the dimming range of the lamp is limited. Moreover, for more non-linear lamps the dimming range is limited to less than 50%.

As discussed above, it has been found that operation of the Micro Linear circuitry is limited when driving a fluorescent lamp that is more non-linear than the T8 or T12 type lamps. For example, a T5 lamp extinguishes at or about 50% dimming. This limited dimming range is usually unsatisfactory. The suggestions in the Users Guide do not help.

Also, these and other prior art inventions are inefficient in their use of electrical components. The transformers and variable inductors and capacitors must be arranged and configured for the higher power outputs and, thus, must be larger than needed for the lower power outputs.

An object of this invention is to provide a feedback arrangement for dimming a very non-linear fluorescent lamp with a manual setting, and where the power rating and size of the electrical components are more optimum over the range of different lumen outputs. Another object is to provide an extended range of dimming for fluorescent lamp and, especially, lamps more non-linear than the T8 and T12 lamps.

It is another object of the present invention to provide a lamp dimmer operating where there is no perceived flicker to the user's eye at dimmed lamp light levels.

SUMMARY OF THE INVENTION

The foregoing objects are met in circuitry that allows the light output to be reduced to about 10% of full output for fluorescent lamps that have significantly more non-linear characteristics. The circuitry includes a feedback loop where the loop speed is substantially increased over prior art circuits. This increased speed allows dimming control of the non-linear T5 fluorescent lamp to well below 30% of full light output. There is a significant advantage of controlling the dimming of these non-linear lamps over a wide dimming range. There are physical configurations where a non-linear lamp, like the T5, can only be used, and the ability to dim such a lamp provides a significant performance advantage over non-dimmable arrangements. A feedback loop exists with a settable desired lumen or light intensity output. The actual lamp current is compared to the current represented by the desired setting thus generating an error signal. The feedback loop acts to reduce the error signal forcing the lamp current and so the light output to the desired level.

The feedback apparatus for controlling the lumen output of the fluorescent light lamp includes an inverter for generating a controlled frequency current through the lamp, means for sensing the current in said lamp, adjusting means for setting a lumen output level for said lamp, means for comparing said current to said setting to form an error signal, responsive to said error signal, feedback means to vary said inverter frequency to change said current such that the lumen output of the lamp changes in a manner corresponding to said setting. Increasing the loop speed of the feedback circuitry to provide higher frequency operations allow the lamp to be dimmed to lower than 30% but not be extinguished. This phenomenon was not known or understood in the prior art, and there is no suggestions of the limitation of the loop speed as a factor in dimming of fluorescent lamps. In a preferred embodiment, the feedback loop frequency has been modified to provide a faster feedback loop speed than previously suggested so that the lamp dimming can range down to less than 30%. If other stray capacitance is eliminated the dimming can range down to about 10% or even lower.

Other preferred embodiments may use variable inductors and/or saturable transformers and other variable impedance components where the change in impedance causes a change in the lamp current.

In a preferred embodiment, a switch that changes the light output from 100% to 50% will often cause a fluorescent lamp to extinguish. One reason not suggested or understood by the prior art was that the feedback loop speed was too slow. In such an instance, the lamp current being sampled is reduced precipitously but the frequency of the lamp current signal has not changed. When the feedback loop speed is slow, the feedback error signal (as defined and used in classic feedback circuitry) exists for the time needed for the loop speed to achieve its steady state operating point. During this transition the lamp current is reduced to the point of extinction and may remains off for most of the loop delay time. But, when a fast feed back loop exists the time that the lamp is off is much smaller in the same ratio as the quicker loop speed. In effect in the prior art designs will cause current pulses in the lamp separated by the feedback delay time when the lamp is off. This operation causes flicker and a reduced dimming range for the lamp.

The present invention provides for a fast feedback loop where there is no noticeable flicker and the dimming range of the lamp is extended.

In a preferred embodiment a dimmable electronic ballast circuit, the ML4831 from Micro Linear, has been found to be unsuitable for driving a T5 or other such non-linear lamp. The ML4831 dimmer design is pointed at T12 and T8 fluorescent lamps which are relatively linear. These lamps require a high starting voltage and a large working current. However, in the present design a T5 lamp is used which exhibits very non-linear characteristics compared to the T12 and T8 lamps. In particular with the T5 lamp, dimming the light output below 50% is difficult, and the ML4831 continuous current source is not useful. In order to dim a T5 lamp the current source is discontinuous such that the new operating point is quickly achieved, and the quickness is effective in keeping the lamp lit.

Other objects, features and advantages will be apparent from the following detailed description of preferred embodiments thereof taken in conjunction with the accompanying drawing in which:

DETAILED DESCRIPTION OF PREFERRED EMBODIMENTS

Figure 3:
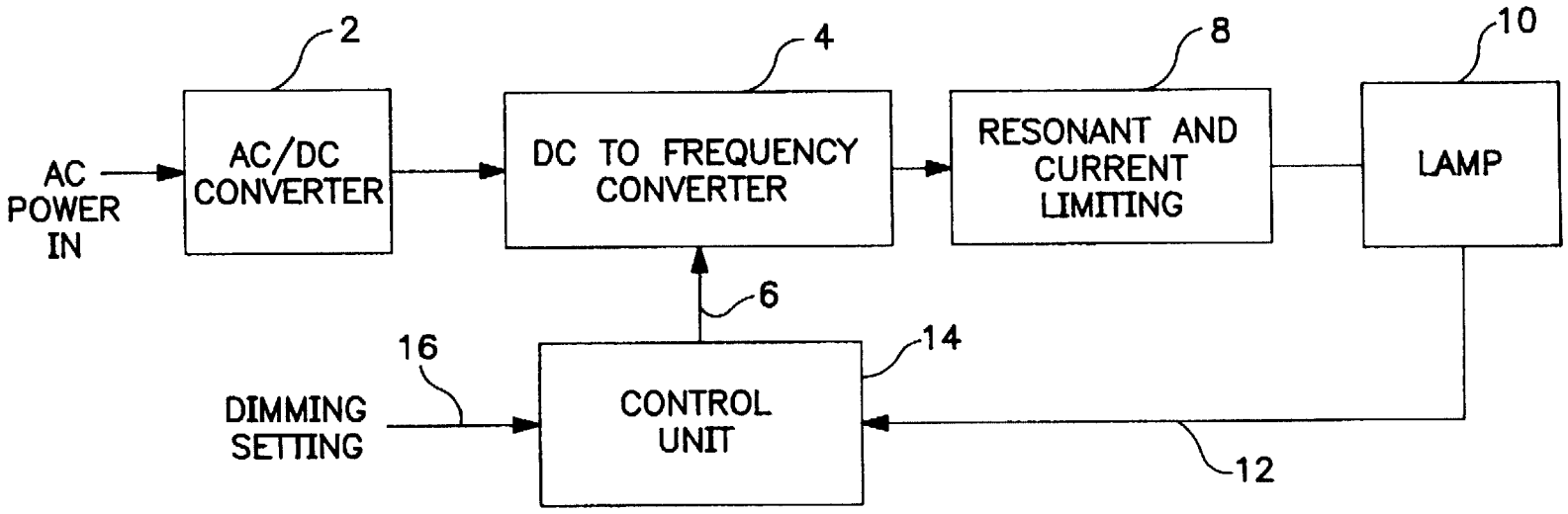
FIG. 3 is a circuit block diagram of a feedback control circuit.

In FIG. 3, 120 VAC power is supplied to an AC to DC converter 2. The DC output is fed to a frequency converter 4 which has a control input 6. The range of frequencies is from about 30K Hz to 50K Hz. The output of the frequency converter 4 is fed to a resonant circuit and current limiter 8. The output of the current limiter 8 is an AC current that drives the lamp 10. The Resonant block 8 looks inductive at the frequencies involved The lamp current is fed back 12 to a control circuit 14. The control circuit outputs the signal 6 which controls the frequency of the frequency converter 4. Another input to the control circuit is a dimming setting 16. When the light is to be dimmed the setting 16 is changed and which results in a higher frequency output from the frequency converter. The higher frequency signal results in less lamp current since the resonant circuit 8 looks inductive thereby providing a higher impedance at the higher frequencies and thus less current.

In the present invention the loop speed, that is the time required for a signal to traverse the loop from the frequency converter to the resonant circuit to the lamp to the control circuit and back to the frequency converter requires about 50 microseconds. By contrast the loop speed of the prior art Micro Linear circuit is about 5 milliseconds having a bandwidth of about 160 Hz. The impact of this delay is that the DC to frequency converter outputs a higher frequency and therefor less current to the lamp for a time of about 5 milliseconds. If the current level is near the extinguishing threshold of the lamp, the light will be off for the 5 milliseconds. The feedback system ultimately responds and, depending upon the dimming required and other circuit parameters as are known in the art of feedback circuitry, the voltage will rise above the voltage discharge threshold and light the lamp again. The result is graph of FIG. 1, where the peaks occur 5 milliseconds apart and where the lamp is lighted only during these peaks. Noticeable flickering of the light occurs under these conditions. As discussed previously, the time where the lamp is off allows the cathode to cool which has the erratic effect of changing the voltage discharge threshold.

Any reduction in the 5 millisecond of the feedback loop circuitry is advantageous regarding range of dimming and flicker. In another preferred embodiments, feedback speeds of 0.5 milliseconds and 50 microseconds and less can be used to advantage.

In a corresponding manner, using bandwidth rather than speed as a parameter, increases in the feedback loop frequency is advantageous, and loop frequencies exceeding 160 Hz, and frequencies of 1.6 kHz, and 16 kHz have been used to advantage.

Figure 2A:
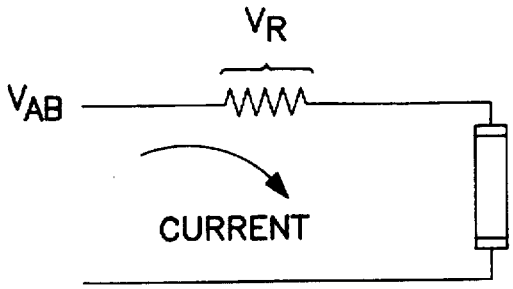
FIG. 2A is a circuit diagram.
Figure 2B:
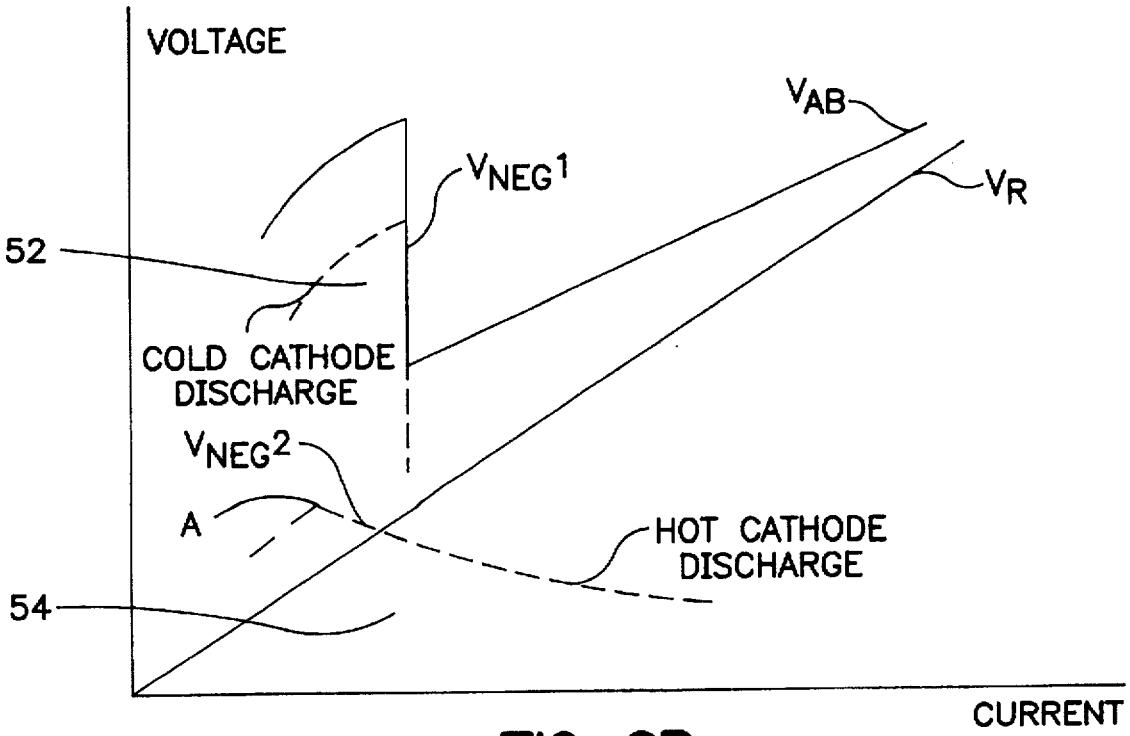
FIG. 2B is a voltage/current graph of the non-linear nature of fluorescent lamps.
Figure 2C:
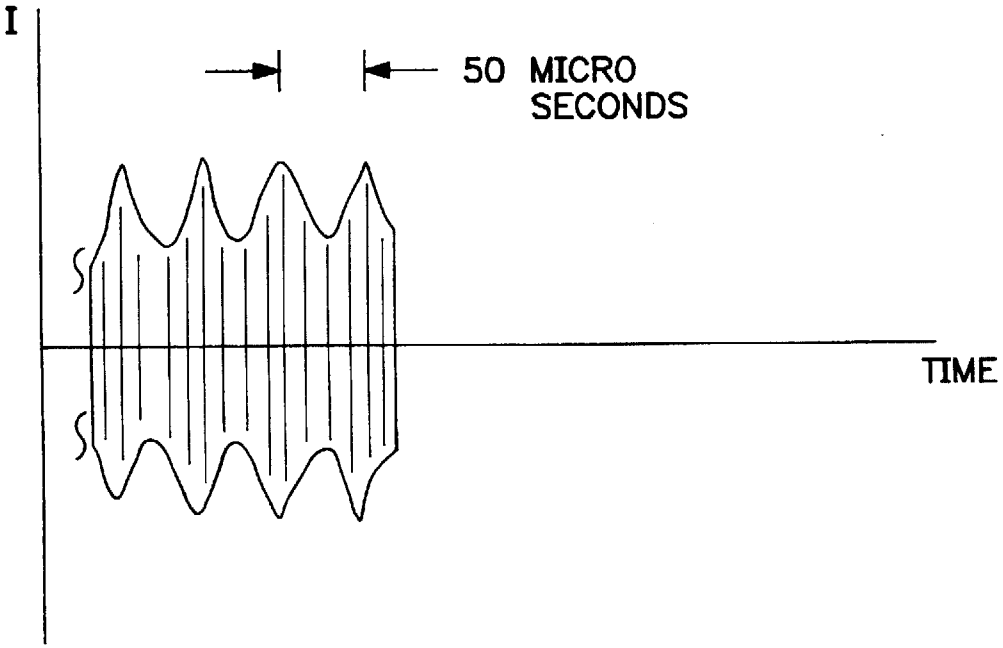
FIG. 2C is a graph of the lamp current of the present invention at dimmed light levels.

FIG. 2C shows the effect of a higher frequency feedback circuit where the response is about 50 microseconds. In this representation of the present invention the time between discharge of the lamp is small and the cooling of the cathode will be more uniform allowing the dimming to occur in a more uniform manner over a larger range of dimming and with no flickering.

FIG. 2B shows the voltage current profile for a typical fluorescent lamp and the combination of a lamp and the resistive element as shown in FIG. 2A. With reference to FIG. 2B, the line Vr is the resistive voltage drop with current which is, obviously, linear, and the curve Vab is the sum of the drops across the resistor and the lamp. Of note is the negative resistance part of the curve VNEG1 where a cold discharge cathode lamp lights. As the cathode heats up the negative resistance portion changes to the curve marked VNEG2—hot cathode discharge. Under hot cathode conditions where Vab is reduced to reduce light output there will be a point where the applied voltage Vab will not reach the discharge peak A and the lamp will be permanently off. Before this point there will be an operating condition where the applied voltage is low and the lamp is off more than it is on. In this condition the cathode will cool raising the discharge threshold and causing erratic operation and eventual extinguishing of the lamp. This previously described operation is exacerbated when the feedback loop speed is slow. In the Micro Linear circuitry and Users Manual operates with a feedback loop speed that allows cathode cooling an associated erratic lamp operation. This is a limitation of slow feedback circuitry for controlling fluorescent lamp dimming.

The present invention teaches a feedback circuit that is one hundred times faster than that described in the Micro Linear application note. The unrecognized advantage of this faster feedback loop is that the cathode will not cool down allowing the operation at low lamp currents to be more predictable and controllable. Thus the hot cathode characteristic will allow lower light output than the cold cathode since the hot cathode will operate in the area marked 52 while the colder cathode use will be in the area marked 54.

Figure 1:
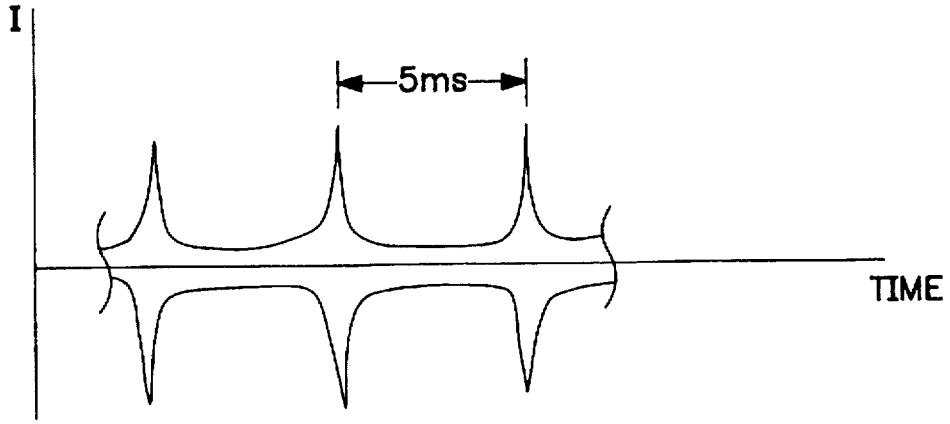
FIG. 1 PRIOR ART
FIG. 1 is a graph of prior art circuitry lamp current at dimmed light levels.

FIG. 1 shows the current at low light with the slow Micro Linear circuit, and the graph of FIG. 2C shows the current with the faster feedback loop. Here there is only 50 microseconds where the lamp current is low and the lamp un-lighted. There is a peak of current every 50 microseconds which provides for flicker free operation and maintains the cathode at a high temperature so that the erratic nature of the lamp with a cooling cathode is avoided until much lower current levels are reached.

Figure 4:
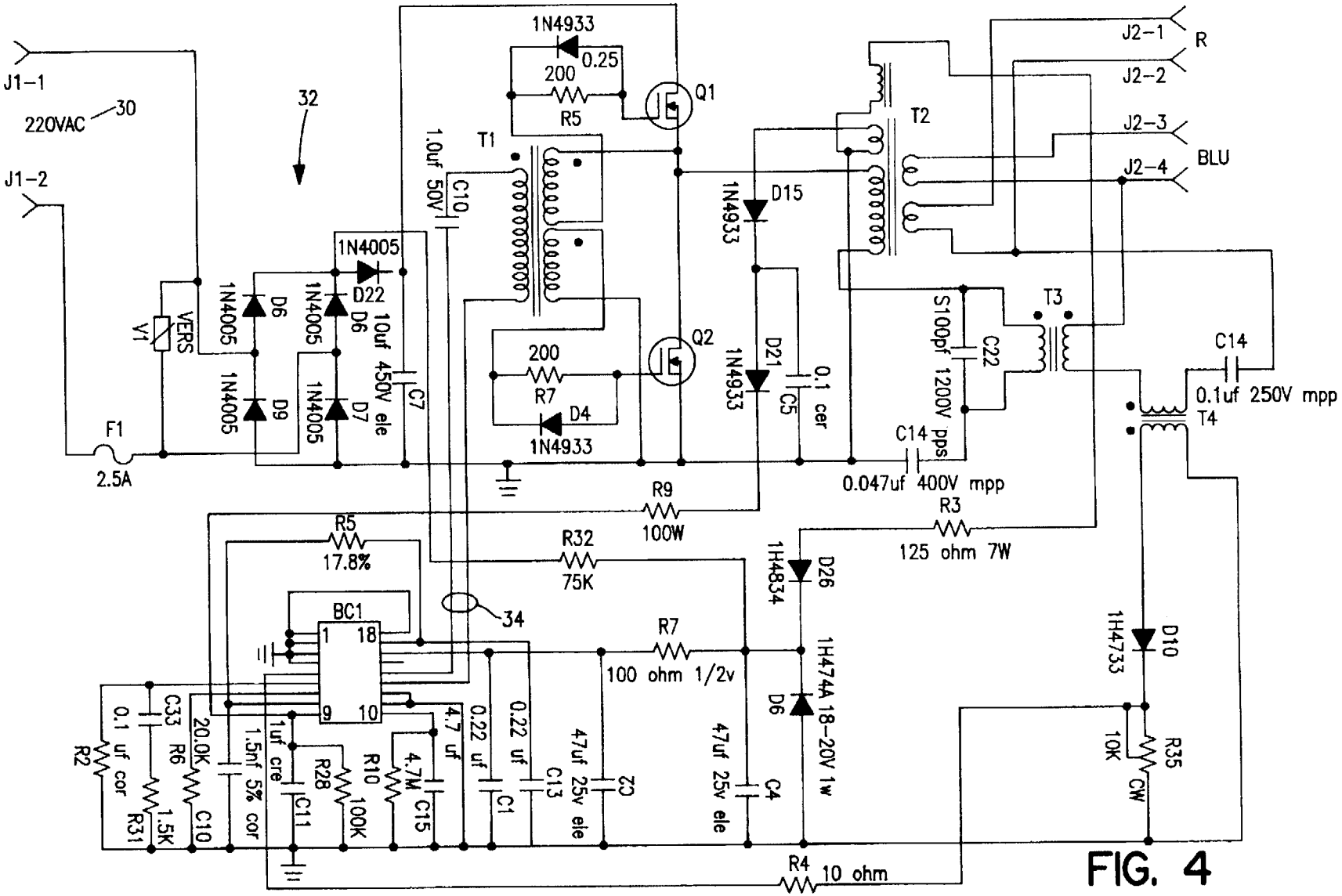
FIG. 4 is a circuit diagram made in accordance with the present invention.

FIG. 4 shows the circuit of a preferred embodiment. 220 VAC 30 is input to a rectifying circuit 32 that provides a DC voltage to a totem pole MOSFETs Q1 and Q2. The transformer T1 and the related circuitry D25, R3, C18, R7 and d4 drives the MOSFETs producing an AC voltage with a frequency range from about 10K Hz to about 50K Hz. This signal is transferred to the lamp via the transformer T2 and C22 which provide the main resonant circuit. C16 is a DC blocking capacitor that provides a high voltage when at resonance. T4 is an isolation transformer that couples the high voltage to the lamp for ignition. C14 is another blocking capacitor to avoid the rectifying effect of the lamp itself. A winding on t2 leading to R3, D26, D6, R1, C6, and c2 provide power to IC1. T4, D10, and R35 convert current to voltage. This circuit produces a voltage signal proportional to the lamp current. D19, D21 and C5 are the lamp failure detecting circuit.

V1 is a varistor that protects the circuitry from high voltage spikes. Rectifying diodes D5, D7, D8, and D9 convert the AC signal to DC.

D22 is an anti-flickering diode. When power turned off if the voltage to IC1 is allowed to gradually fall off to ground there will be a flickering in the lamp. The filter capacitor voltage on C7 will not power IC1 (via R32) since D22 blocks the voltage on C7.

IC1 is the Micro Linear ML 4831 electronic Ballast Controller IC. In the Micro Linear Users Guide this chip is used in a dimming configuration which is significantly different from the circuit of the FIG. 4. The circuit changes between the circuitry of FIG. 4 and the Micro Linear circuits increase the loop speed by a factor of 100 in a preferred embodiment. The Micro Linear Users Guide is hereby incorporated herein by reference as though laid out in full. In particular, in the ML 4831 circuit CKT #1, there are several capacitors connecting to pins 1–4 and pin 18. In the inventive circuit of FIG. 4 these pins are grounded thereby eliminating five capacitors. In addition, in the ML 4831 CKT# 1, there are several resistors connecting to pin 5, and all of these resistors are in the 5 to 10K ohm range and higher. In FIG. 4 this resistor is changed to 10 ohms These are the changes that increase the loop speed by a factor of 100 in this preferred embodiment.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In apparatus for controlling the lumen output of a fluorescent lamp having means for generating a controllable current through said lamp, means for sensing the actual current through said lamp, adjustable means for setting a desired current though said lamp, means for comparing said desired current to said controllable current to generate an error signal, and, responsive to said error signal, a feedback loop having a time delay associated with said feedback loop for varying said controllable current to match said desired current such that the lumen output of the lamp changes in a corresponding manner, the improvement comprising means for constructing said feedback loop with a time delay of less than about 0.5 milliseconds.

2. Apparatus as defined in claim 1 wherein said feedback loop delay is less than about 0.05 milliseconds.

3. Apparatus as defined in claim 1 wherein said means for generating a controllable current through said lamp comprises:

an inverter means that provides an AC current over a range of frequencies as said controllable current, and circuit means having an inductive component over said range of frequencies such that the magnitude of the current decreases with increasing frequency.

4. Apparatus as defined in claim 3 where the range of frequencies extends from about 10 KHz to about 30 KHz.

5. In apparatus for controlling the lumen output of a fluorescent lamp having means for generating a controllable current through said lamp, means for sensing the actual current through said lamps adjustable means for setting a desired current though said lamp, means for comparing said desired current to said controllable current to generate an error signal, responsive to said error signal, feedback loop means for varying said controllable current to match said desired current such that the lumen output of the lamp changes in a corresponding manner, the improvement comprising means for constructing said feedback loop bandwidth greater than about 160 Hz.

6. Apparatus as defined in claim 5 where the feedback bandwidth is greater than about 1.6 KHz.

7. Apparatus as defined in claim 5 where the feedback bandwidth is greater than about 16 KHz.

* * * * *